US007277628B2

(12) United States Patent
Giamati

(10) Patent No.: US 7,277,628 B2
(45) Date of Patent: Oct. 2, 2007

(54) HEATER FOR AIRCRAFT POTABLE WATER TANK

(75) Inventor: Michael J. Giamati, Akron, OH (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 11/621,681

(22) Filed: Jan. 10, 2007

(65) Prior Publication Data

US 2007/0127900 A1 Jun. 7, 2007

Related U.S. Application Data

(63) Continuation of application No. 10/434,649, filed on May 9, 2003.

(60) Provisional application No. 60/379,721, filed on May 10, 2002.

(51) Int. Cl.
*F24H 1/18* (2006.01)

(52) U.S. Cl. ..... 392/444; 219/541

(58) Field of Classification Search ..... None
See application file for complete search history.

(56) References Cited

U.S. PATENT DOCUMENTS

| | | | | |
|---|---|---|---|---|
| 2,564,325 | A | 8/1951 | Coonly | 244/134 |
| 2,786,211 | A | 3/1957 | Culver, Jr. | 4/187 |
| 3,525,799 | A | 8/1970 | Ellis | |
| 3,702,910 | A | 11/1972 | Akeley | 200/84 |
| 4,037,083 | A | 7/1977 | Leavines | 219/552 |
| 4,412,898 | A | 11/1983 | Olson et al. | 204/159.18 |
| 4,460,472 | A | 7/1984 | Kapiloff et al. | 210/639 |
| 4,468,557 | A | 8/1984 | Bylin et al. | 219/535 |
| 4,553,023 | A | 11/1985 | Jameson et al. | 219/301 |
| 4,566,973 | A | 1/1986 | Masler, III et al. | 210/701 |
| 4,629,868 | A | 12/1986 | Svensson | 219/528 |
| 4,869,905 | A | 9/1989 | Sobek et al. | 426/406 |
| 4,969,991 | A | 11/1990 | Valadez | 210/96.2 |
| 5,032,290 | A | 7/1991 | Yamagata et al. | 210/747 |
| 5,290,996 | A | 3/1994 | Giamati et al. | 219/201 |
| 5,293,654 | A | 3/1994 | Castwall et al. | 4/598 |
| 5,303,739 | A | 4/1994 | Ellgoth et al. | 137/899.2 |
| 5,309,938 | A | 5/1994 | Ellgoth et al. | 137/334 |

(Continued)

FOREIGN PATENT DOCUMENTS

EP 0 654 402 A1 11/1994

(Continued)

OTHER PUBLICATIONS

EP 03 25 2919; Partial European Search Report dated Feb. 19, 2007.

*Primary Examiner*—Thor S. Campbell
(74) *Attorney, Agent, or Firm*—Renner, Otto, Boisselle & Sklar

(57) ABSTRACT

A heater (10) for installation on a potable water tank (12). The heater (10) comprises a blanket (14) including an electrical resistance heating element (16) and a connection pad (18) for electrically connecting the heating element (16) to lead lines (20) to an aircraft power source (22). The water tank (12) is typically positioned under the cabin floor or other locations on an aircraft which are susceptible to cold temperatures, moisture invasion, and pressure drops/rises caused by changing altitudes. The heater (10) maintains the tank (12) at an acceptable temperature range and prevents freezing of the water.

20 Claims, 7 Drawing Sheets

U.S. PATENT DOCUMENTS

| | | | | |
|---|---|---|---|---|
| 5,351,337 | A | 9/1994 | Deutsch | 392/450 |
| 5,393,932 | A | 2/1995 | Young et al. | 174/84 |
| 5,552,576 | A | 9/1996 | Giamati | 219/201 |
| 5,573,687 | A | 11/1996 | Tanaka | |
| 5,622,207 | A | 4/1997 | Frank | 137/899.2 |
| 5,658,465 | A | 8/1997 | Nicholas et al. | 210/698 |
| D391,971 | S | 3/1998 | Dorsey | D15/79 |
| 5,794,658 | A | 8/1998 | Saikin | 137/563 |
| 5,938,078 | A | 8/1999 | Dorsey et al. | 222/105 |
| 6,082,590 | A | 7/2000 | Dorsey et al. | 222/146.6 |
| 6,095,372 | A | 8/2000 | Dorsey et al. | 222/105 |
| 6,211,494 | B1 | 4/2001 | Giamati et al. | 219/482 |
| 6,412,344 | B1 | 7/2002 | Danicich et al. | 73/290 |
| 6,463,956 | B2 | 10/2002 | Walker | 137/563 |
| 2002/0009540 | A1 | 1/2002 | Sasaki | |
| 2003/0007789 | A1 | 1/2003 | Pagnella | 392/472 |

FOREIGN PATENT DOCUMENTS

| | | |
|---|---|---|
| EP | 0624920 | 11/1994 |
| EP | 0 556 765 B1 | 1/1997 |
| EP | 0824299 | 2/1998 |
| EP | 1 102 044 A1 | 5/2001 |
| EP | 1 209 368 A2 | 5/2002 |
| EP | 1 221 594 A2 | 7/2002 |
| LU | 78728 | 4/1978 |

HEATER FOR AIRCRAFT POTABLE WATER TANK

RELATED APPLICATION

This application claims priority under 35 U.S.C. §120 to U.S. patent application Ser. No. 10/434,649 filed on May 9, 2003 which claimed priority under 35 U.S.C. § 119(e) to U.S. Provisional Patent Application No. 60/379,721 filed on May 10, 2002. The entire disclosures of these earlier applications are hereby incorporated by reference.

FIELD OF THE INVENTION

The present invention relates generally as indicated to a heater for an aircraft potable water tank and, more particularly, to a heater comprising a blanket with an electrical resistance heater element.

BACKGROUND OF THE INVENTION

An aircraft typically has one or more potable water tanks on board to accommodate the aircraft's plumbing system. Such water tanks are commonly cylindrical in shape and can range in size depending upon the aircraft and/or the number of tanks on board. In any event, a potable water tank is typically positioned under the cabin floor or other locations on the aircraft which are susceptible to cold temperatures, moisture invasion, and pressure drops/rises caused by changing altitudes.

A heater can be provided to maintain the tank at an acceptable water temperature range and to prevent freezing of the water. In one common type of heater, an electrothermal blanket is shaped and sized to be wrapped around the tank (with openings for plumbing inlets/outlets) and is secured to the tank with appropriately placed lacing hooks. The blanket includes a pattern of wire that forms an electrical resistance heating element connected to a power source on the aircraft to generate the desired heat.

To make the blanket for such a heater, a work platform is provided with pins placed in locations corresponding to the desired heating element pattern. A first layer of a carrier material having appropriately placed pin-accommodating openings is placed on the work platform. The heater wire is then wrapped around the pins to create the desired pattern, and a second layer of carrier material is then placed over the pattern so that the resistance wire is sandwiched therebetween. These and possibly other compiled layers are then cured to encapsulate the resistance wire.

A potable water tank is often made of an electrically conductive material, such as stainless steel or a graphite composition. Accordingly, or in any event, a heating assembly must be designed to guard against electrical shorts. To this end, the carrier layers in the heating blanket are made of an electrically insulating material such as silicone. As long as the carrier layers do not allow the introduction of water or moisture, the heating element circuit will remain electrically insulated.

In the past, heater blankets have incorporated Teflon-coated wire to protect against electrical shorts when a fluid (e.g., hydraulic oil) migrates through the silicone carrier layers. However, the "slickness" of the Teflon coating complicated assembly procedures, particularly the wire-winding process. Specifically, the Teflon-coated wire would not "stick" to a silicon carrier layer (which has a clay-like consistency in an uncured state) during the winding process.

To prevent the wire from "jumping" out of the pattern, small tie-down strips of silicone material had to be placed over winding paths throughout the pattern, dramatically slowing the process.

Moreover, the intactness of the Teflon coating was found to be difficult, if not impossible, to obtain during the manufacture of the heating element. Specifically, pins on the work platform would crease or nick the Teflon coating, thereby providing a leakage path. Also, Teflon has a tendency to "cold flow" around pin-imposed corners during the construction of the heating element. Further, damage to the coating can occur from fingernails during handling of the coated wire. Accordingly, even with Teflon-coated wire, the integrity of the carrier layers remains crucial to keeping the heating element electrically insulated.

SUMMARY OF THE INVENTION

The present invention provides a heater assembly for a potable water tank wherein the heating element will remain electrically isolated regardless of the integrity of the carrier layers. In this manner, the invasion of moisture into the carrier layers will not affect the electrical insulation of the heating element.

More particularly, the present invention provides a heater comprising a heating element and a carrier layer for the heating element. The heating element comprises a wire structure positioned in a pattern to generate required heating. The wire structure comprises an electrically conductive wire, an electrically insulating coating on the wire, and a fiber overwrap surrounding the insulating coating. The wire can be made of a metal or a metal alloy; the insulating coating can be made of polytetrafluoroethylene (Teflon); and the fiber overwrap can be made of nylon, rayon, polyester, polypropylene, polyvinylchloride, polyethylene and/or copolymers thereof.

The fiber overwrap serves to protect the electrically insulating coating, whereby the coating can remain intact before, during, and after the manufacture of a heater blanket. Specifically, the overwrap prevents pins on the work platform from nicking or creasing the coating during winding, eliminates "cold-flows" around pin-imposed corners, and guards against fingernail and other handling damage. By keeping the electrically insulating coating intact, the integrity of carrier layers is not crucial to the electrical insulation of the heating element. Additionally (or alternatively), the overwrap provides a surface for the uncured silicone to mechanically grip during the winding process. This significantly decreases wire-winding labor time. For example, a winding process which would have taken about six to seven hours with unwrapped Teflon-coated wire would take about one to two hours with the present invention.

The present invention also provides a crimp joint for between an end portion of the wire structure and a lead wire to a power source. The crimp joint comprises a crimp that electrically connects bare wire ends of the lead wire and the end portion of the wire structure, a first sleeve which protects the insulating coating on the end portion of the wire structure, and a second sleeve which surrounds the crimp and seals it relative to the insulating coating on the wire structure and the lead wire. Both of the sleeves have a dual wall construction comprising an outer wall and an inner wall. The outer wall is made of a Teflon-grade material which shrinks but does not melt when heated, and the inner wall is made of a Teflon-grade material which melts at a temperature near the melting point of the insulating coating for the wire. In this manner, sealing of the crimp can be accomplished by heating and "shrinking" the sleeve to thermally fuse it to the insulating coatings.

The wire structure and/or the crimp joint of the present invention are believed to provide adequate electrical insulation independent of other components of the heater. In other words, the wire structure and/or the crimp joint could satisfy electrical insulation requirements without having to be embedded or encapsulated further in an insulating medium. This greatly increases the ability of the heater to meet some rigorous requirements that conventional heaters could not even hope to satisfy. For example, a heater can be constructed according to the present invention that meets dielectric and insulation requirements during and after withstanding total immersion in a saltwater solution (i.e., waterproof) while undergoing seven vacuum cycles per day (to simulate altitude cycling of the aircraft) for a total duration of thirty days.

These and other features of the invention are fully described and particularly pointed out in the claims. The following description and annexed drawings set forth in detail a certain illustrative embodiment of the invention, this embodiment being indicative of but one of the various ways in which the principles of the invention may be employed.

DRAWINGS

DETAILED DESCRIPTION

Figure 1:
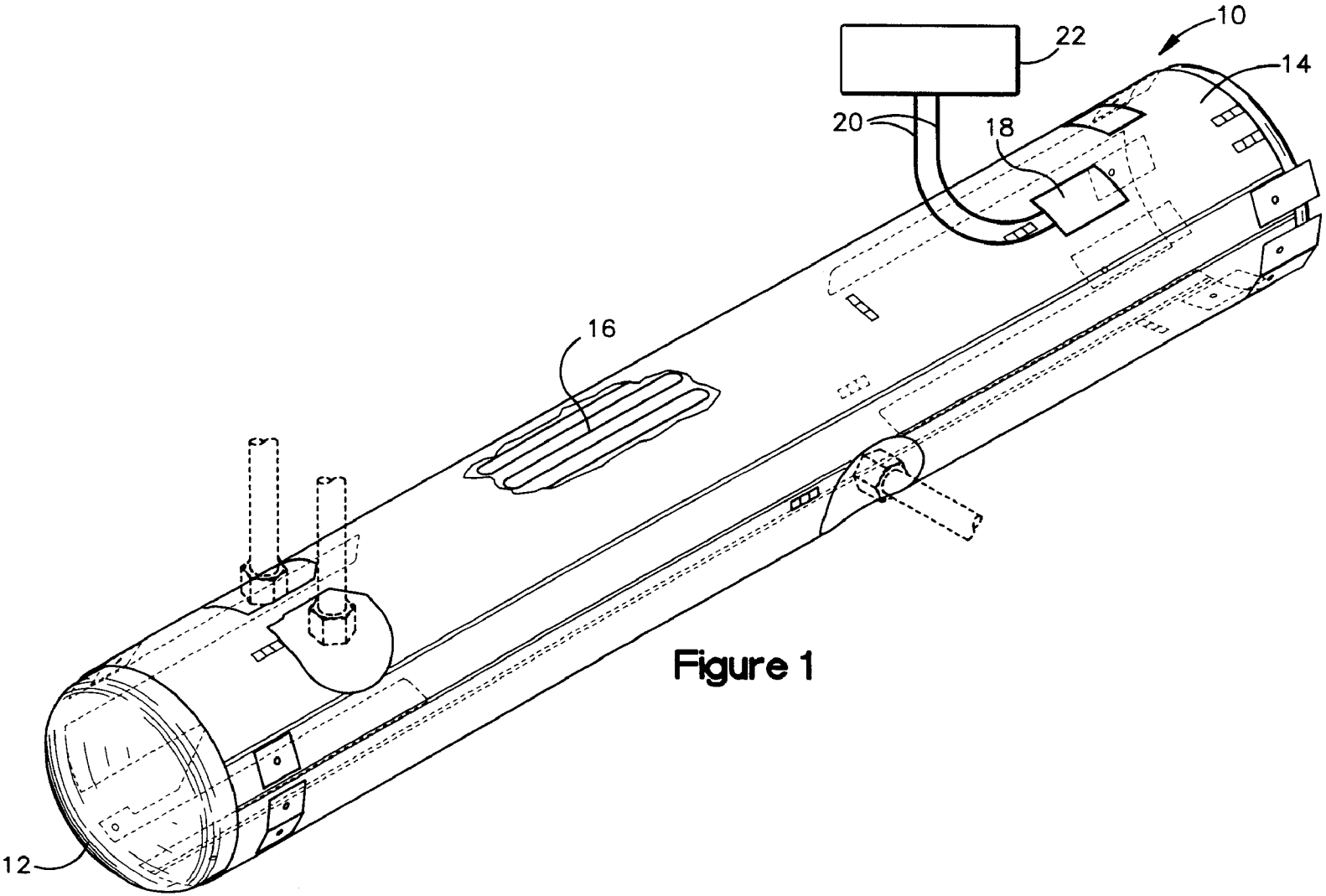
FIG. 1 is a schematic view of a heater assembly according to the present invention installed on a potable water tank.

Referring now to the drawings, and initially to FIG. 1, a heater 10 according to the present invention is shown installed on a potable water tank 12. The heater 10 comprises a blanket 14 including an electrical resistance heating element 16 and a connection pad 18 for electrically connecting the heating element 16 to lead lines 20 to an aircraft power source 22. The water tank 12 is typically positioned under the cabin floor or other locations on an aircraft which are susceptible to cold temperatures, moisture invasion, and pressure drops/rises caused by changing altitudes. The heater 10 maintains the tank 12 at an acceptable temperature range and prevents freezing of the water.

Figure 2:
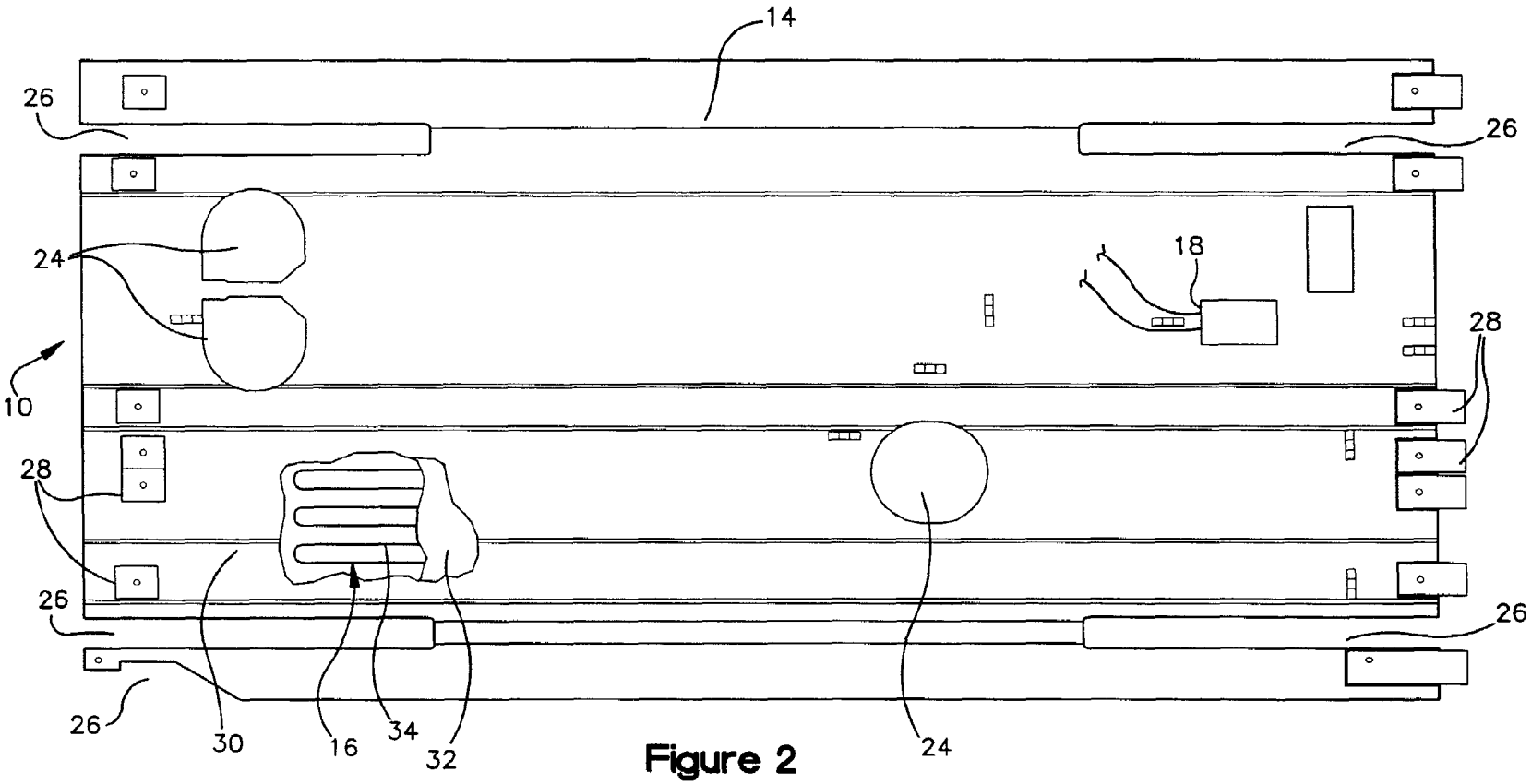
FIG. 2 is a top view of the blanket of the heater assembly, with certain layers removed for purposes of explanation.

Referring now to FIG. 2, the heater 10 is shown isolated from the water tank. The blanket 14 is shaped and sized to correspond to the geometry of the water tank 12 (FIG. 1) whereby, in the illustrated embodiment, it has a roughly rectangular shape corresponding to the tank's cylindrical geometry. Openings 24 can be provided to fit around the tank's ports (e.g., inlet, outlet and/or pressurization ports), cut-outs 26 can be provided to accommodate the tank's mounting brackets, and/or lacing hooks 28 can be provided to attach the blanket 10 to the water tank.

The blanket 14 comprises an outer layer 30 of carrier material and an inner layer 32 of carrier material, and the heating element 16 is sandwiched therebetween. More layers of carrier material can be provided, if necessary, for a particular situation. It may be noted that with the present invention, the carrier material need not be electrically insulating (e.g., need not be silicone) as is required in conventional heating blankets for dielectric purposes. That being said, silicone could still be the preferred material for the carrier layers 30/32 because it may have other advantageous properties (e.g., lightweight, flexible, thermally insulating, etc.) independent of electrical insulation.

Figure 2A:
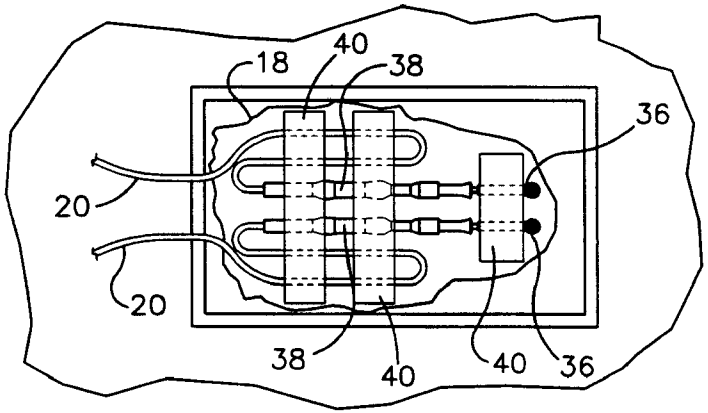
FIG. 2A is an enlarged portion of FIG. 2 showing a lead line connection pad.

The heating element 16 comprises a preferably continuous wire structure 34 arranged in a conventional multi-turn pattern of a desired density. As shown in more detail in FIG. 2A, end sections 36 of the wire structure 34 pass through appropriately placed openings in the outer layer 30 to the connection pad 18. The connection between the end sections 36 and the lead lines 20 is accomplished via two crimp joints 38. The lead wires 20 may be looped as shown and the loops, as well as the end sections 36, can be held in place with tie-down strips 40.

Figure 3A:
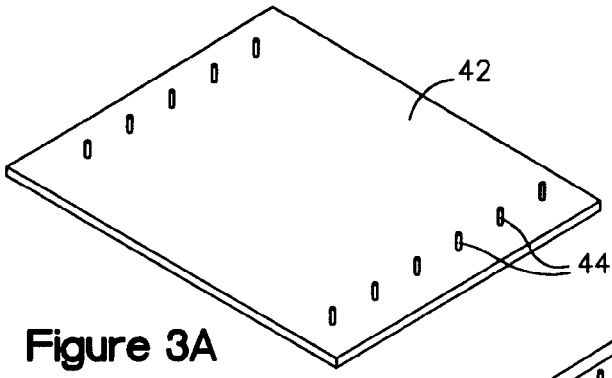
FIGS. 3A–3E are schematic views of the steps of making a heater blanket according to the present invention.

A method of making the blanket 14 is shown in FIGS. 3A–3E. In the illustrated method, a work platform 42 is provided with pins 44 placed in locations corresponding to the desired heating element pattern. (FIG. 3A.) It may be noted that the pattern formed by the pins 44 on the illustrated work platform 42 is much less complex and/or much less dense than would be found on most heating blankets. This pattern has been simplified in the schematic illustrations only for ease in explanation and is not representative of the complexity of expected heating element patterns.

Figure 3B:
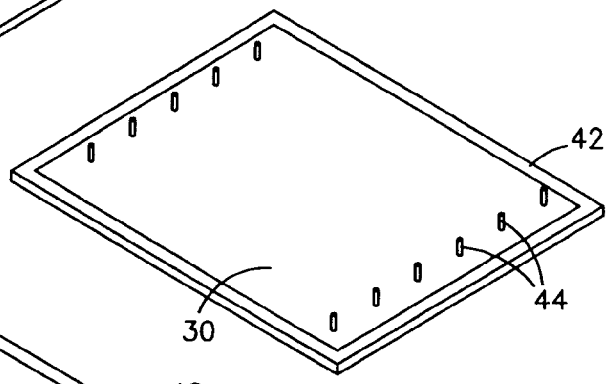
Figure 3C:
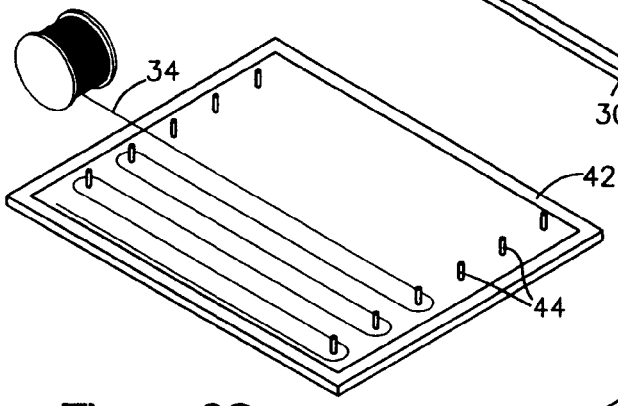
Figure 3D:
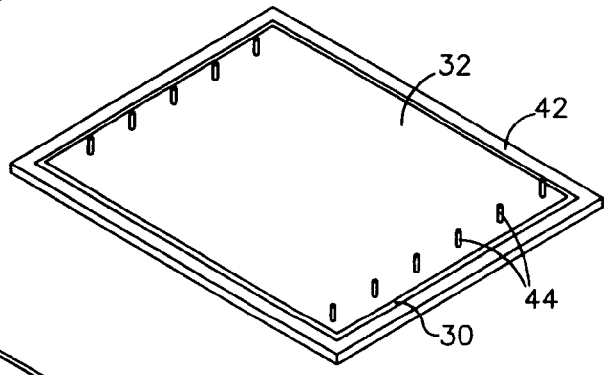
Figure 3E:
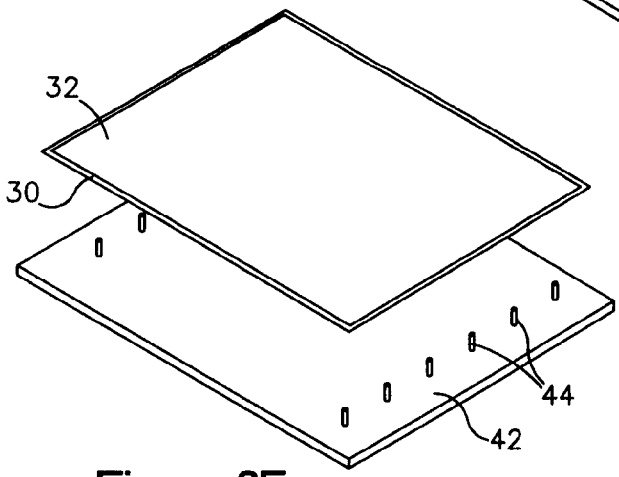

One layer of carrier material (e.g., the outer layer 30) has appropriately placed pin-accommodating openings and is placed on the work platform 42. (FIG. 3B.) The wire structure 34 is then wrapped around the pins 44 to create the desired pattern. (FIG. 3C.) Another layer of carrier material (e.g., the inner layer 32), also having appropriately placed pin-accommodating openings, is placed over the pattern so that the wire structure 34 is sandwiched between the two layers 30/32. (FIG. 3D.) The compiled layers are then lifted from the work platform 42 (FIG. 3E) and then cured in a suitable manner. If the blanket 14 is to include additional carrier layers, these layers can be added after the lifting step (FIG. 3E) and before the curing step.

Figure 4A:
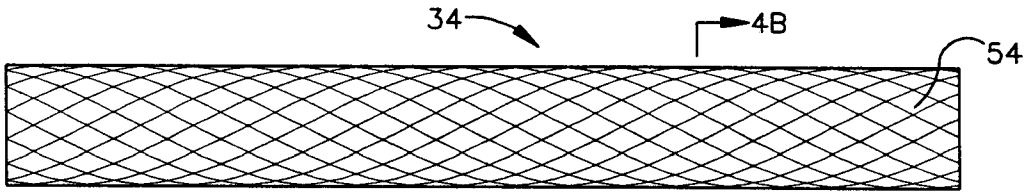
FIG. 4A is an enlarged top view of the wire used to form the resistance heating element.
Figure 4B:
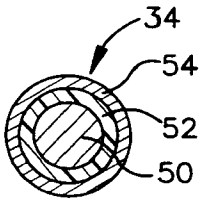
FIG. 4B is a sectional view as seen along lines 4B—4B in FIG. 4A.

Referring now additionally to FIGS. 4A and 4B, the wire structure 34 is shown in detail. The wire structure 34 comprises an electrically conductive wire 50, an electrically insulating coating 52, and an overwrap 54. The wire 50 can be made of any suitable conductive material (e.g. a metal or a metal alloy) compatible with the intended use of the wire structure 34. For example, the wire 50 can be made from several (e.g., seven) alloy 90 strands of 34#AWG with a twist rate consistent with the required resistance.

The coating 52 can be made of any appropriate electrically insulating material which has the required flexibility to accommodate manufacturing techniques and/or installation. For example, the coating 52 can be made of Teflon (polytetrafluoroethylene), such as Grade 340 Teflon. Typically, the coating 52 will have a nominal 0.005 inch wall thickness.

The overwrap 54 can be made of a fiber having, for example, a spiral wound or woven construction. The fiber can be selected from the group comprising nylon, rayon, polyester, polypropylene, polyvinylchloride, polyethylene and copolymers thereof. For example, the overwrap 54 can be constructed by double serve wrapping nylon fibers. Typically, the overwrap 54 will have a nominal 0.002 inch wall thickness.

The overwrap 54 serves to protect the electrically insulating coating 52, whereby the coating 52 remains intact before, during, and after the manufacture of the blanket 14. Specifically, the overwrap 54 prevents the pins 44 from nicking or creasing the coating 52, eliminates "cold-flows" around pin-imposed corners, and guards against fingernail and other handling damage before and during the manufacturing process. By keeping the electrically insulating coating 52 intact, the integrity of the carrier layers 30/32 is not crucial to the electrical insulation of the heating element 16.

In addition to protecting the coating 52, overwrap 54 also plays another important role during the construction or assembly of the heater 10. In the past, Teflon-coated wire would not "stick" to a silicone carrier layer (which has a clay-like consistency in an uncured state) during the winding process. To prevent the wire from "jumping" out of the pattern, small tie-down strips of silicone material had to be placed over winding paths throughout the pattern, dramatically slowing the process. The construction of the present invention eliminates this problem, as the overwrap 54 provides a surface for the uncured silicone to mechanically grip during the winding process. This significantly decreases wire-winding labor time. For example, a winding process which would have taken about six to seven hours with unwrapped Teflon-coated wire would take about one to two hours with the present invention.

Figure 5A:
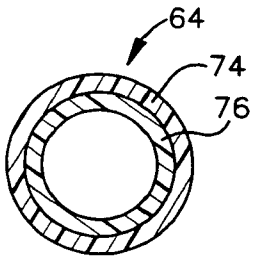
FIG. 5A is an enlarged side view of the shrink-wrap tube used in the crimp.
Figure 5:
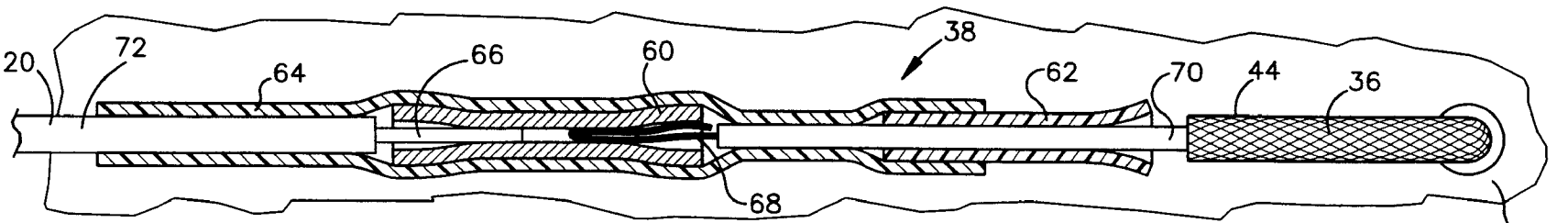
FIG. 5 is an enlarged sectional view of a crimp joint.

Referring now to FIG. 5, one of the crimp joints 38 is shown in detail. The crimp joint 38 comprises a crimp 60, a sleeve 62, and another sleeve 64. The crimp 60 serves as the electrical connection between bare wire ends 66 and 68 of the lead wire 20 and the heater element end portion 36, respectively. The sleeve 62 is positioned around an unwrapped section 70 of the end portion 36 (i.e., with the coating 52 but not the overwrap 54) and is partially thermally fused thereto. The sleeve 64 surrounds the crimp 60, extends over insulating coating 72 of the lead wire 20, over insulating coating 52 of the heater element end portion 36, and over the sleeve 62, and is thermally fused or bonded thereto.

As shown in FIG. 5A, the sleeve 64 has a dual wall construction with an outer wall 74 and an inner wall 76. The outer wall 74 is made of a material which shrinks but does not melt when heated, and the inner wall 76 is made of a material which melts at a temperature near the melting point of the coating 52. For example, the outer wall 74 can be made of PTFE grade of Teflon and, if the coating 52 is made of Grade 340 Teflon, the inner wall 76 can be made of FEP grade Teflon. Such a product is manufactured and sold by Zeus Industrial Products under Vendor Part No. ZDS-L-130. The sleeve 62 can be made of a similar material but of a smaller diameter, sold by Zeus Industrial Products under Vendor Part No. ZDS-S-036. It may be noted that these sleeve materials also provide a flexible completed connection to accommodate curved installation situations and the flexible nature of silicone heaters.

Figure 6A:
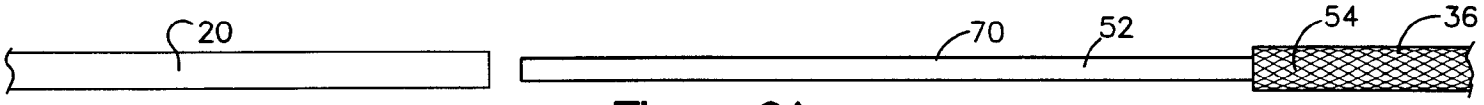
FIGS. 6A–6I are schematic views showing the assembly of the crimp in the lead-line connection.
Figure 6B:
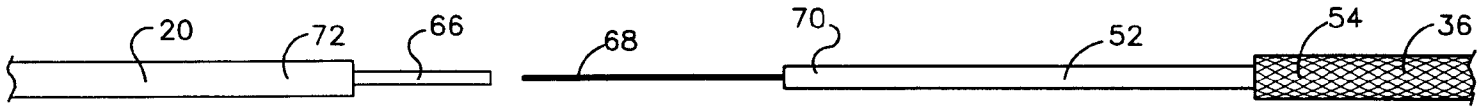
Figure 6C:
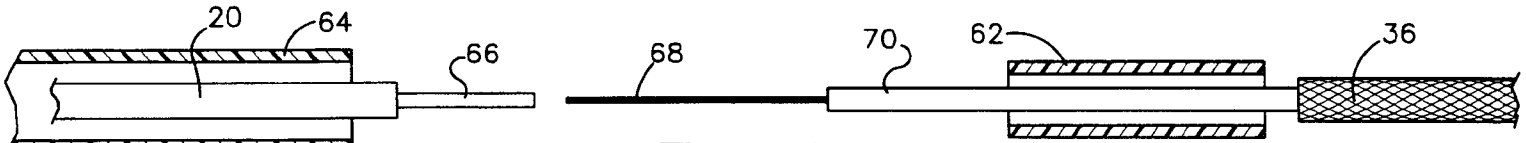
Figure 6D:
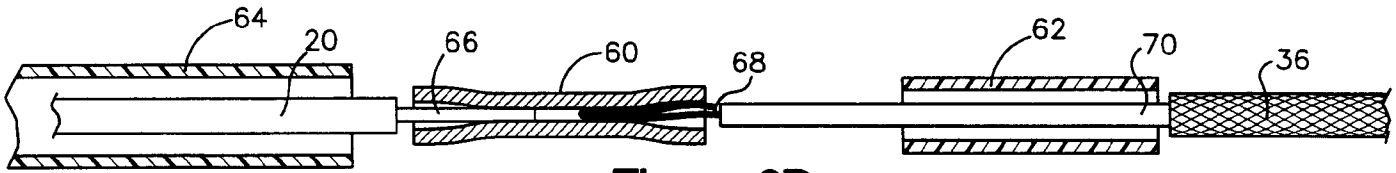
Figure 6E:
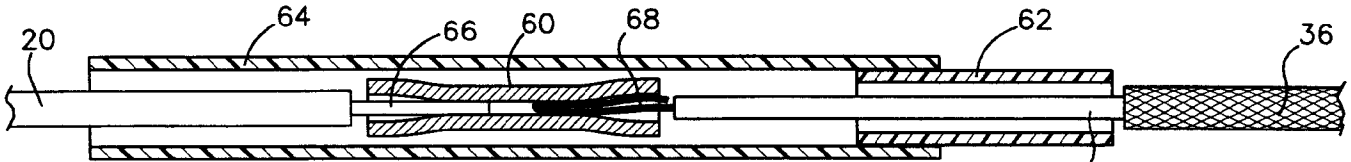

Referring now to FIGS. 6A–6I, a method of making the crimp joint 38 according to the present invention is shown. In this method, the wrapping 54 is trimmed off a distal section of the end portion 36 to form the unwrapped section 70. (FIG. 6A.) The coating 52 is stripped from an end section of the unwrapped section 70 and insulating coating 72 is stripped from an end section of the lead wire 20 to expose bare wire ends 66 and 68. (FIG. 6B.) The sleeve 62 is then placed on the unwrapped section 70 and the sleeve 64 is placed on the lead wire 20. (FIG. 6C.) The bare wire ends 66 and 68 are then assembled with the crimp 60 with, in the illustrated embodiment, the bare wire end 68 being folded to fill the crimp's barrel. (FIG. 6D.) The sleeve 64 is then slid over the crimp 60 and partially over the unwrapped section 70 and the sleeve 62. (FIG. 6E.)

Figures 6F, 6G, 6H, 6I:
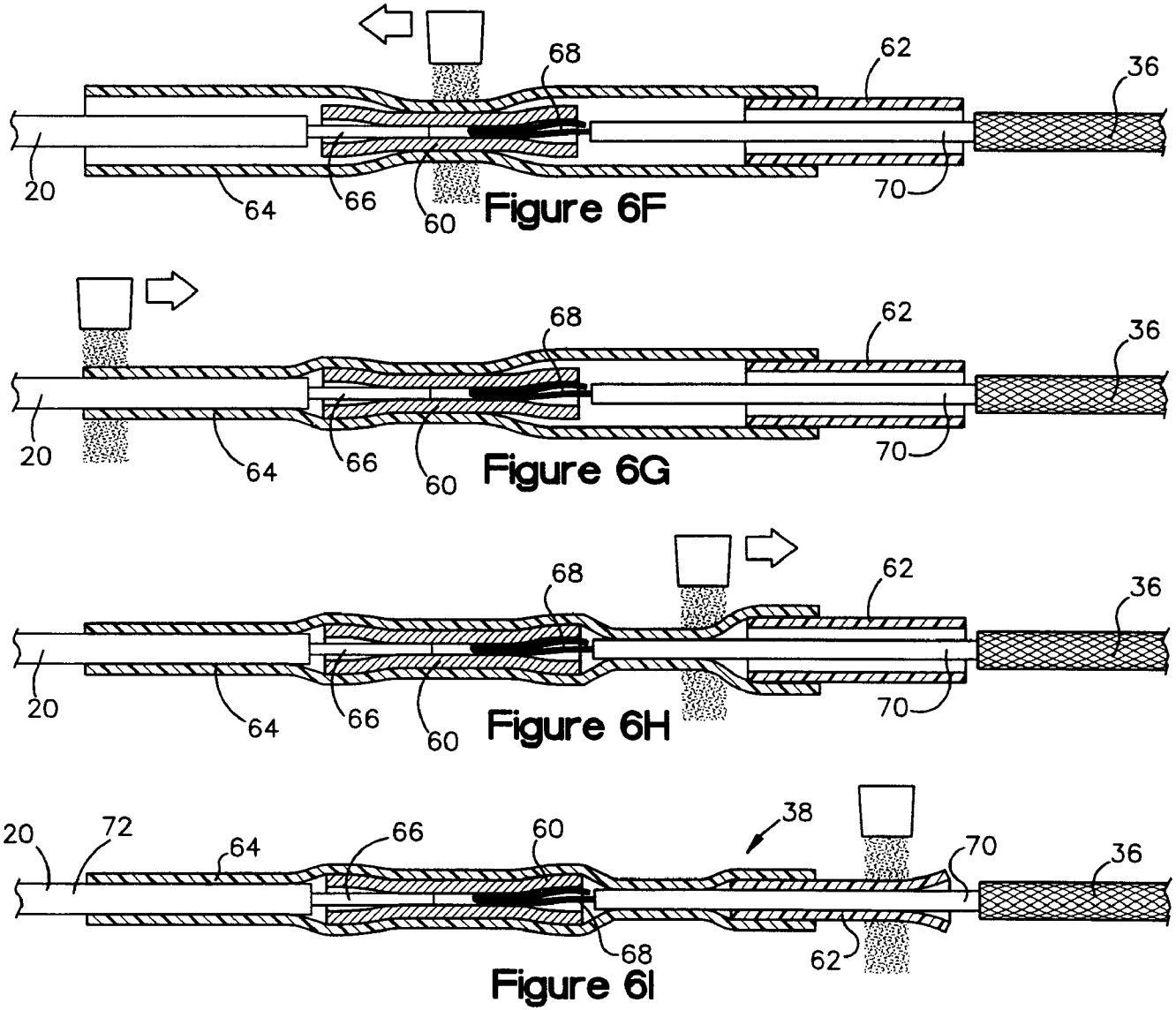

A heat gun or other suitable device is then used to heat the sleeve 64. The heating can start at the center of the crimp 60 (FIG. 6F), move towards the lead wire 20, return towards the center of the crimp 60 (FIG. 6G), and then move towards the end portion 36 (FIG. 6H). This heating pattern causes the sleeve 64 to thermally bond or fuse to the lead wire 20, the heating element end portion 36, and the sleeve 62 and to shrink to seal the same. Significantly, the heating purposely stops short of the end of the sleeve 62 so that a remote section of the sleeve 62 remains unheated (see FIG. 6I). In this manner, the sleeve 62, and particularly its unheated portion, acts as a heat shield to prevent the coating 52 on the unwrapped section 70 from being damaged (e.g., melted) during the heating of the sleeve 64.

The wire structure 34 and/or the crimp joint(s) 38 of the present invention are believed to provide adequate electrical insulation independent of other components of the heater 10. In other words, the wire structure 34 and/or the crimp joint 38 can satisfy electrical insulation requirements without having to be embedded or encapsulated further in an insulating medium. This greatly increases the ability of the heater 10 to meet some rigorous requirements that conventional heaters could not even hope to satisfy. For example, a heater can be constructed according to the present that meets dielectric and insulation requirements during and after withstanding total immersion in a saltwater solution while undergoing seven vacuum cycles per day (to simulate altitude cycling of the aircraft) for a total duration of thirty days. Thus, the heater can be constructed to be not only moisture resistant and/or water resistant, but to be also waterproof.

Figure 7:
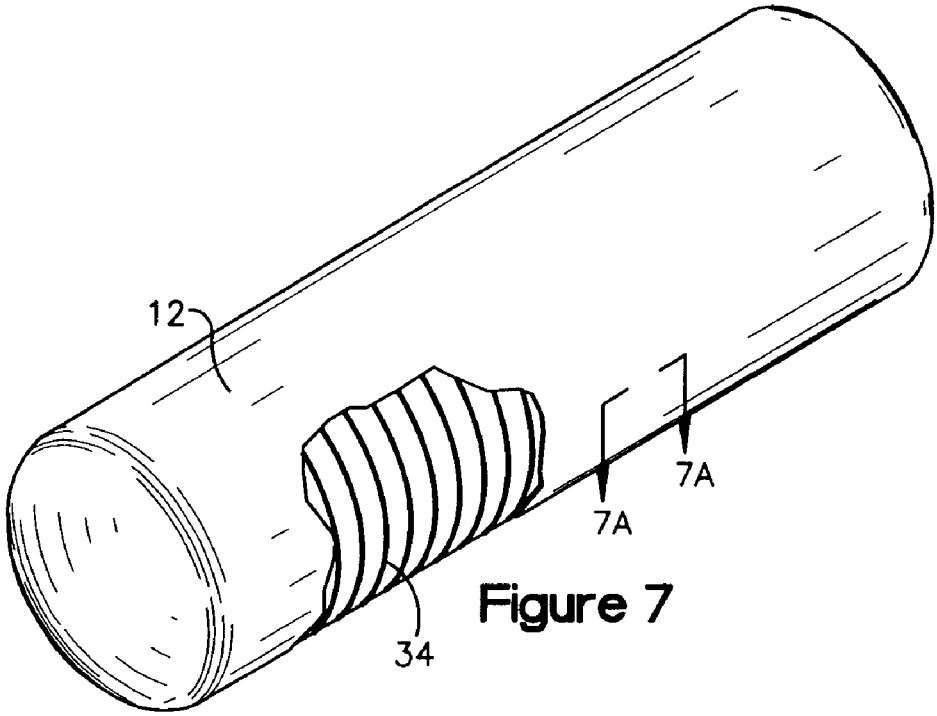
FIG. 7 is a water tank incorporating the wire structure of the present invention.
Figure 7A:
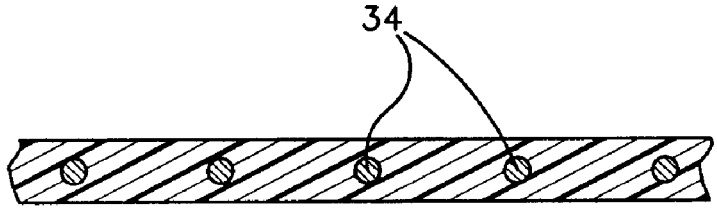
FIG. 7A is a schematic cross-section of the water tank shown in FIG. 7.
Figure 8:
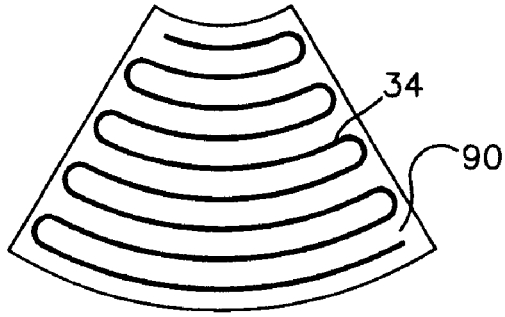
FIG. 8 is a turbine blade incorporating the wire structure of the present invention.

With particular reference to the wire structure 34, it has been discussed in detail with relation to the resistance heating element 16 within the blanket 14. However, the "self-insulating property" of the wire structure 34 could allow the heater element 16 to be incorporated directly into a composite water tank 12, as shown in FIG. 7, or structural composites in other applications. With conventional heater elements, dielectric layers on either side of the wire pattern would be required for electrical insulation purposes. This forms a heating element laminate. The layers in the laminate are typically made from epoxy/fiberglass materials, which are cured together while encapsulating the element in the center of the sandwich. In order to ensure the structural integrity of the tank or the composite structure, bonding or adhesion to these cured insulating layers is necessary to provide the appropriate load-carrying characteristics. In this case, the element laminate also has to be able to transfer the structural load through the composite matrix. With the wire structure 34 of the present invention, such dielectric layers (and the bonding of these layers to rest of the tank) can be eliminated. As shown in FIG. 7A, the wire structure 34 can simply be embedded, for example, in the graphite/epoxy composition without any insulating layers. This is done during the manufacturing of the composite tank. The wire structure is simply placed into the composite ply lay-up. The structural loads then pass around or in between the wire structure and there are not any bondlines to a laminate that require special bonding techniques. Furthermore, a composite structure without internal bondlines is inherently stronger and is less likely to structurally fail. As shown in FIG. 8, for example, the wire structure 34 of the present invention could be incorporated into a fiberglass turbine blade 90.

Although the invention has been shown and described with respect to a certain preferred embodiment, it is evident that equivalent and obvious alterations and modifications will occur to others skilled in the art upon the reading and understanding of this specification. The present invention includes all such alterations and modifications and is limited only by the scope of the following claims.

The invention claimed is:

1. An electrical connection comprising a wire structure, a lead wire, and a crimp joint;

the wire structure comprising an electrically conductive wire, an electrically insulating coating on the wire, and a fiber overwrap surrounding the insulating coating, the wire structure having an unwrapped end section without the fiber overwrap and a bare wire end of the unwrapped end section without the insulating coating;

the lead wire comprising an electrically conductive wire and an insulating coating on the wire; the lead wire having a bare end without the insulating coating;

the crimp joint comprising a crimp, a first sleeve, and a second sleeve;

the crimp electrically connecting the bare wire end of the lead wire and the bare wire end of the wire structure;

the first sleeve being positioned around the electrically insulating coating of the unwrapped end section of the wire structure;

the second sleeve surrounding the insulating coating of the lead wire, the crimp, the insulating coating of unwrapped end section of the wire structure, and the first sleeve; and the second sleeve being thermally bonded to the insulating coating of the lead wire and thermally bonded to the insulating coating of the unwrapped end section and/or the first sleeve.

2. An electrical connection as set forth in claim 1, wherein the second sleeve has a dual wall construction with an outer wall and an inner wall;

the outer wall is made of a material which shrinks but does not melt when heated; and the inner wall is made of a material which melts at a temperature near the melting point of the insulating coating on the wire structure.

3. An electrical connection as set forth in claim 1, wherein the first sleeve is partially thermally fused to the insulating coating of the end portion of the wire structure.

4. An electrical connection as set forth in claim 3, wherein the first sleeve has a dual wall construction with an outer wall and an inner wall;

wherein the outer wall is made of a material which shrinks but does not melt when heated; and wherein the inner wall is made of a material which melts at a temperature near the melting point of the insulating coating on the wire structure.

5. An electrical connection as set forth in claim 1, wherein the electrically conducting wire of the wire structure is made of a metal.

6. An electrical connection as set forth in claim 1, wherein the insulating coating of the wire structure is made of polytetrafluoroethylene.

7. An electrical connection as set forth in claim 1, wherein the fiber overwrap of the wire structure comprises a fiber made of nylon, rayon, polyester, polypropylene, polyvinylchloride, polyethylene and/or copolymers thereof.

8. An electrical connection as set forth in claim 7, wherein the overwrap is constructed by spiral wrapping a fiber around the insulating coating.

9. An electrical connection as set forth in claim 1, wherein the conducting wire is made of a metal; the insulating coating is made of polytetrafluoroethylene; and the fiber overwrap comprises nylon, rayon, polyester, polypropylene, polyvinylchloride, polyethylene and/or copolymers thereof.

10. A heater comprising a heating element and a carrier layer for the heating element;

wherein the heating element comprises the electrical connection set forth in claim 1; and wherein the wire structure of the electrical connection is positioned in a pattern in or on the carrier layer to generate required heating.

11. A heater as set forth in claim 10, wherein the carrier layer is made from silicone.

12. A heater as set forth in claim 10, wherein the lead line is connected to a power source.

13. A heater as set forth in claim 10, wherein the lead line is connected to an aircraft power source.

14. A method of making the electrical connection set forth in claim 1, said method comprising the steps of:

trimming the fabric overwrap from the wire structure to form the unwrapped end section;

stripping the insulating coating from the end of the unwrapped section to expose its bare wire end;

assembling the bare wire end of the wire structure and the bare wire end of the lead wire in the crimp;

positioning the first sleeve on the unwrapped section;

positioning the second sleeve around the crimp, over the insulating coating of the lead wire, over the insulating coating of the end portion of the wire structure, and over the first sleeve;

thermally bonding the second sleeve to the insulating coating of the lead wire; and thermally bonding the second sleeve to the insulating coating of the unwrapped end section of the wire structure and/or the first sleeve.

15. A method as set forth in claim 14, wherein said thermally bonding step comprises heating the second sleeve to thermally bond it to the insulating coating of the lead wire and the insulating coating of the unwrapped end section of the wire structure.

16. A method as set forth in claim 15, wherein said heating step comprises leaving a remote portion of the first sleeve unheated to prevent the insulating coating on the unwrapped end section of the wire structure from being damaged during the heating of the first sleeve.

17. In combination, a heating wire structure, a lead wire for connection to a power source, and a crimp joint electrically connecting the heating wire structure to the lead wire;

the crimp joint comprising a crimp, a first sleeve, and a second sleeve;

the crimp electrically connecting a bare wire end of the lead wire and a bare wire end of the heating wire structure;

the first sleeve being positioned around electrically insulating coating of the heating wire structure, adjacent its bare wire end;

the second sleeve surrounding insulating coating of the lead wire, the crimp, the insulating coating of the heating wire structure, and the first sleeve; and the second sleeve being thermally bonded to the insulating coating of the lead wire and being thermally bonded to the insulating coating of the heating wire structure and/or the first sleeve.

18. The combination set forth in claim 17, wherein the second sleeve has a wall adjacent the insulating coating on the heating wire structure and wherein this wall is made of material which melts at a temperature near the melting point of this insulating coating.

19. The combination set forth in claim 17, wherein the second sleeve has a dual wall construction with an outer wall and an inner wall;

wherein the outer wall is made of a material which shrinks but does not melt when heated; and wherein the inner wall is made of a material which melts at a temperature near the melting point of the insulating coating on the wire structure.

20. The combination set forth in claim 17, wherein the first sleeve is partially thermally fused to the insulating coating of the wire structure.

* * * * *